US010760300B2

(12) United States Patent
Chan

(10) Patent No.: US 10,760,300 B2
(45) Date of Patent: Sep. 1, 2020

(54) LOCK MECHANISM

(71) Applicant: TAIWAN FU HSING INDUSTRIAL CO., LTD., Kaohsiung (TW)

(72) Inventor: Tien-Fu Chan, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 58 days.

(21) Appl. No.: 16/176,127

(22) Filed: Oct. 31, 2018

(65) Prior Publication Data

US 2020/0002971 A1 Jan. 2, 2020

(30) Foreign Application Priority Data

Jun. 27, 2018 (TW) ..... 107208605 A

(51) Int. Cl.

| | |
|---|---|
| ***E05B 9/08*** | (2006.01) |
| ***E05B 9/00*** | (2006.01) |
| ***E05B 15/02*** | (2006.01) |
| ***E05B 27/00*** | (2006.01) |

(52) U.S. Cl.

CPC ..... *E05B 9/08* (2013.01); *E05B 9/002* (2013.01); *E05B 15/02* (2013.01); *E05B 27/0003* (2013.01); *E05Y 2900/132* (2013.01)

(58) Field of Classification Search

CPC ..... E05B 9/08; E05B 9/002; E05B 27/0003; E05B 15/02; E05B 9/082; E05B 9/04; E05B 2009/046; E05B 17/0004; E05B 27/0007; E05Y 2900/132

USPC ... 70/134, 367–374, 381, 447–452, DIG. 60, 70/466

See application file for complete search history.

(56) References Cited

U.S. PATENT DOCUMENTS

| | | | | | |
|---|---|---|---|---|---|
| 1,791,029 | A * | 2/1931 | Hurd | E05B 55/00 | 70/452 |
| 4,522,048 | A * | 6/1985 | Davis | E05B 17/2084 | 70/381 |
| 5,233,851 | A * | 8/1993 | Florian | E05B 9/084 | 70/367 |
| 5,590,555 | A * | 1/1997 | Kester | E05B 17/2084 | 292/336.3 |
| 5,761,936 | A * | 6/1998 | Katayama | E05B 3/065 | 292/336.3 |
| 5,845,522 | A * | 12/1998 | Shen | E05B 9/08 | 70/224 |

(Continued)

*Primary Examiner* — Lloyd A Gall

(74) *Attorney, Agent, or Firm* — Jackson IPG PLLC; Demian K. Jackson

(57) ABSTRACT

A lock mechanism includes a first mounting plate, a second mounting plate, a restricting plate, a fixing base, at least one first fixing element and at least one second fixing element. The first mounting plate and the restricting plate are mounted on one side of a door, and the second mounting plate and the fixing base are mounted on the other side of the door. The first fixing element is penetrated through the restricting plate in a direction from the restricting plate toward the second mounting plate. The second fixing element is penetrated through the fixing base in a direction from the fixing base toward the first mounting plate. The fixing base and a lock cylinder disposed on the fixing base can be disassembled and replaced by removing the second fixing element such that dismantling the whole lock mechanism is not necessary.

19 Claims, 7 Drawing Sheets

(56) References Cited

U.S. PATENT DOCUMENTS

| | | | | |
|---|---|---|---|---|
| 5,950,467 | A * | 9/1999 | Dong | E05B 63/10 292/150 |
| 6,698,260 | B2 * | 3/2004 | Su | E05B 15/02 292/356 |
| 6,840,070 | B1 * | 1/2005 | Huang | E05B 3/06 292/348 |
| 7,426,842 | B2 * | 9/2008 | Hsieh | E05B 9/086 70/358 |
| 2008/0016928 | A1 * | 1/2008 | Yang | E05B 9/086 70/367 |
| 2012/0204611 | A1 * | 8/2012 | Chiou | E05B 9/084 70/369 |

* cited by examiner

LOCK MECHANISM

FIELD OF THE INVENTION

This invention relates to a lock mechanism, more particularly, user can disassemble components mounted on one side of a door individually from the lock mechanism.

BACKGROUND OF THE INVENTION

Conventional lock mechanism usually includes a first part mounted on one side of a door and a second part mounted on the other side of the door. During installation of the conventional lock mechanism, user generally uses a screw to connect the first and second parts on two different sides of the door such that the lock mechanism is fixed on the door. However, if any component in the first or second part is broken or requires to be replaced (e.g. cylinder), the user needs to disassemble the screw and then disassemble the first and second parts from the door in order to repair or replace the component. After repairing or replacing, the user also needs to mount the first and second parts on the door and then use the screw to connect the first and second parts. As a result, assembly/disassembly of the conventional lock mechanism is complex and inconvenient to the user.

SUMMARY

The object of the present invention is to provide a lock mechanism having a first mounting plate, a second mounting plate, a restricting plate, a fixing base, at least one first fixing element and at least one second fixing element. For fixing the lock mechanism on the two sides of a door, the first fixing element, penetrated through the restricting plate in a direction from the restricting plate toward the second mounting plate, is provided to fix the restricting plate and the second mounting plate, and the second fixing element, penetrated through the fixing base in a direction from the fixing base toward the first mounting plate, is provided to fix the fixing base and the first mounting plate. When one of the lock mechanism components is broken or needs to be replaced (e.g. lock cylinder), it is easy to be disassembled after removing the first or second fixing element. The lock mechanism of the present invention is different to the conventional lock mechanism that has to be completely disassembled from the door for component repairing or replacing. Assembly and disassembly of the lock mechanism of the present invention are simpler than that of the conventional lock mechanism.

The lock mechanism of the present invention includes a first mounting plate, a second mounting plate, a restricting plate, a fixing base, at least one first fixing element and at least one second fixing element. The restricting plate is coupled to the first mounting plate and located between the first and second mounting plates. The fixing base is disposed on the second mounting plate. The first fixing element has a first end and a second end and is penetrated through the restricting plate in a direction from the restricting plate toward the second mounting plate. The first end is restricted on the restricting plate and the second end is coupled to the second mounting plate such that a clamping space is formed between the restricting plate and the second mounting plate. The second fixing element has a third end and a fourth end and is penetrated through the fixing base in a direction from the fixing base toward the first mounting plate. The third end is restricted on the fixing base and the fourth end is coupled to the first mounting plate.

By removing the first or second fixing element, lock installer can individually disassemble components mounted on different sides of the door from the lock mechanism. Compared to conventional method, component disassembly of the lock mechanism of the present invention is simpler. When a component requires to be disassembled because of damage or replacement requirement, lock installer can disassemble the target component mounted on one side of the door only. The disassembly and assembly operations of the components are simplified owing to disassembling the whole lock mechanism from the door is not necessary.

DETAILED DESCRIPTION OF THE INVENTION

Figure 1:
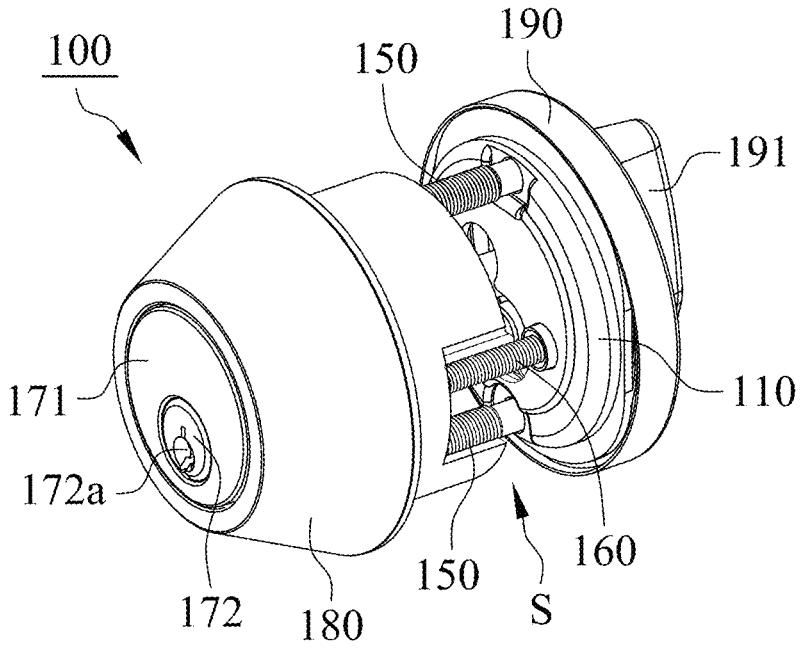
FIG. 1 is a perspective assembly diagram illustrating a lock mechanism in accordance with an embodiment of the present invention.
Figure 2:
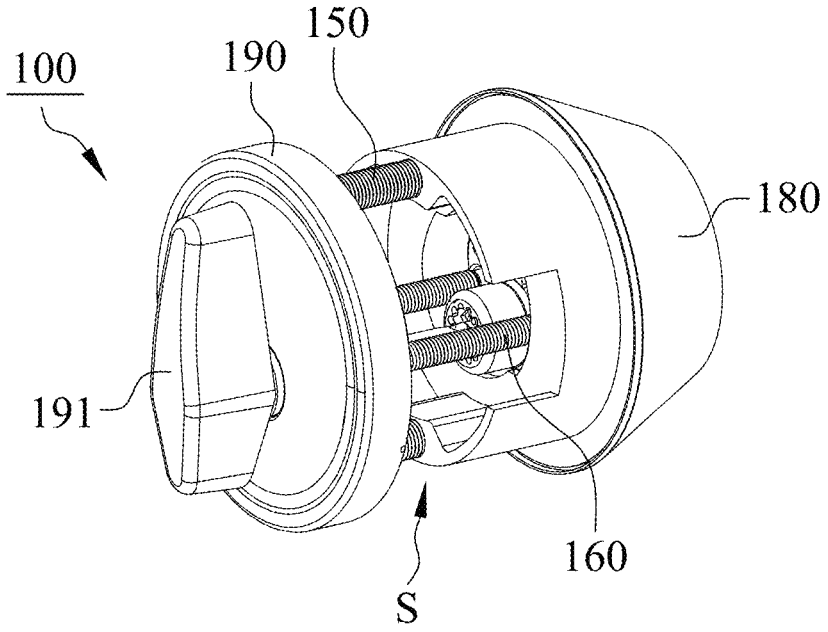
FIG. 2 is a perspective assembly diagram illustrating a lock mechanism in accordance with an embodiment of the present invention.

With reference to FIGS. 1 to 4, a lock mechanism 100 of the present invention includes a first mounting plate 110, a second mounting plate 120, a restricting plate 130, a fixing base 140, at least one first fixing element 150 and at least one second fixing element 160. In this embodiment, the first mounting plate 110 and the restricting plate 130 are installed on one side of a door (not shown), and the second mounting plate 120 and the fixing base 140 are installed on the other side of the door.

Figure 3:
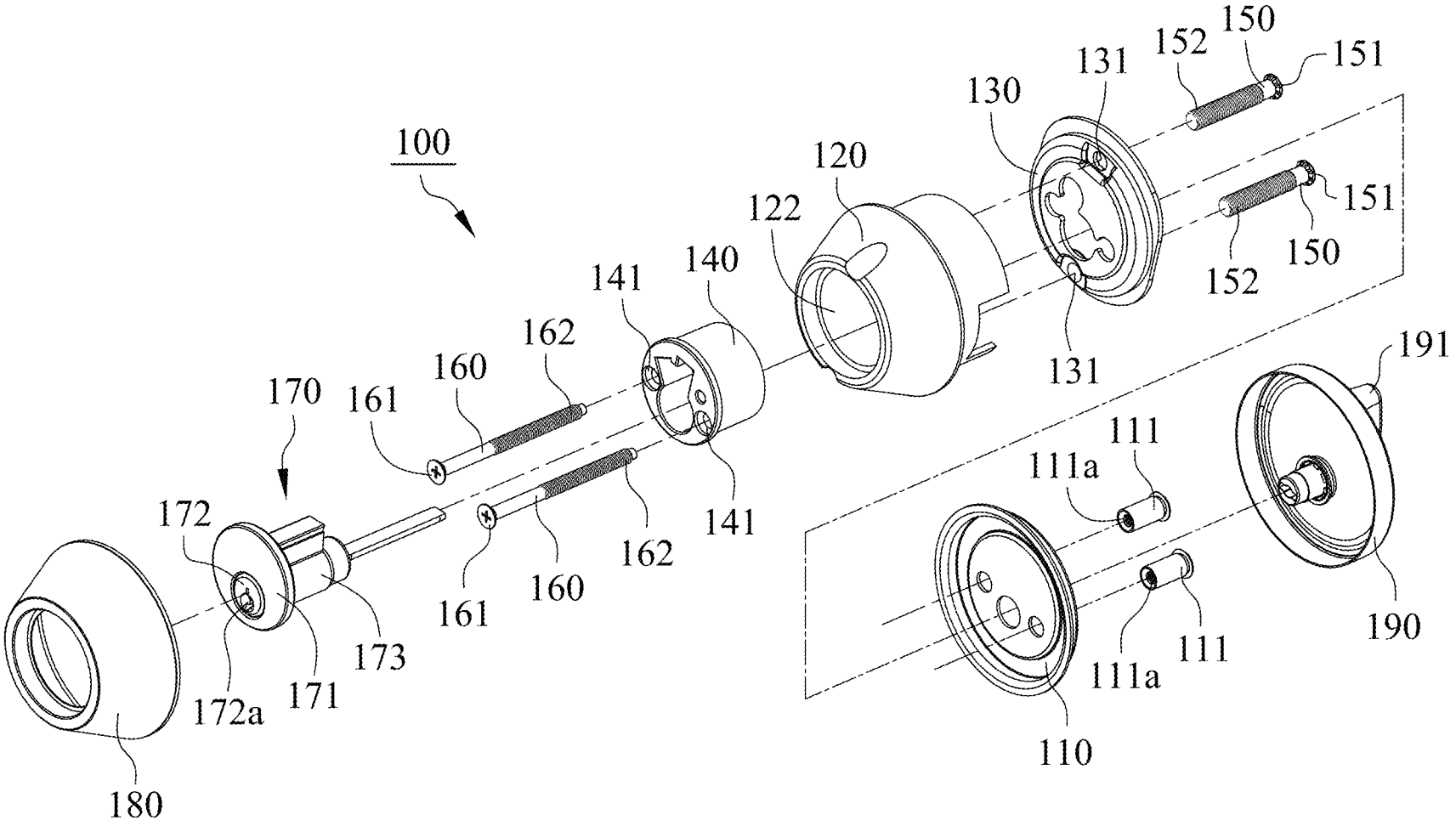
FIG. 3 is a perspective exploded diagram illustrating a lock mechanism in accordance with an embodiment of the present invention.
Figure 4:
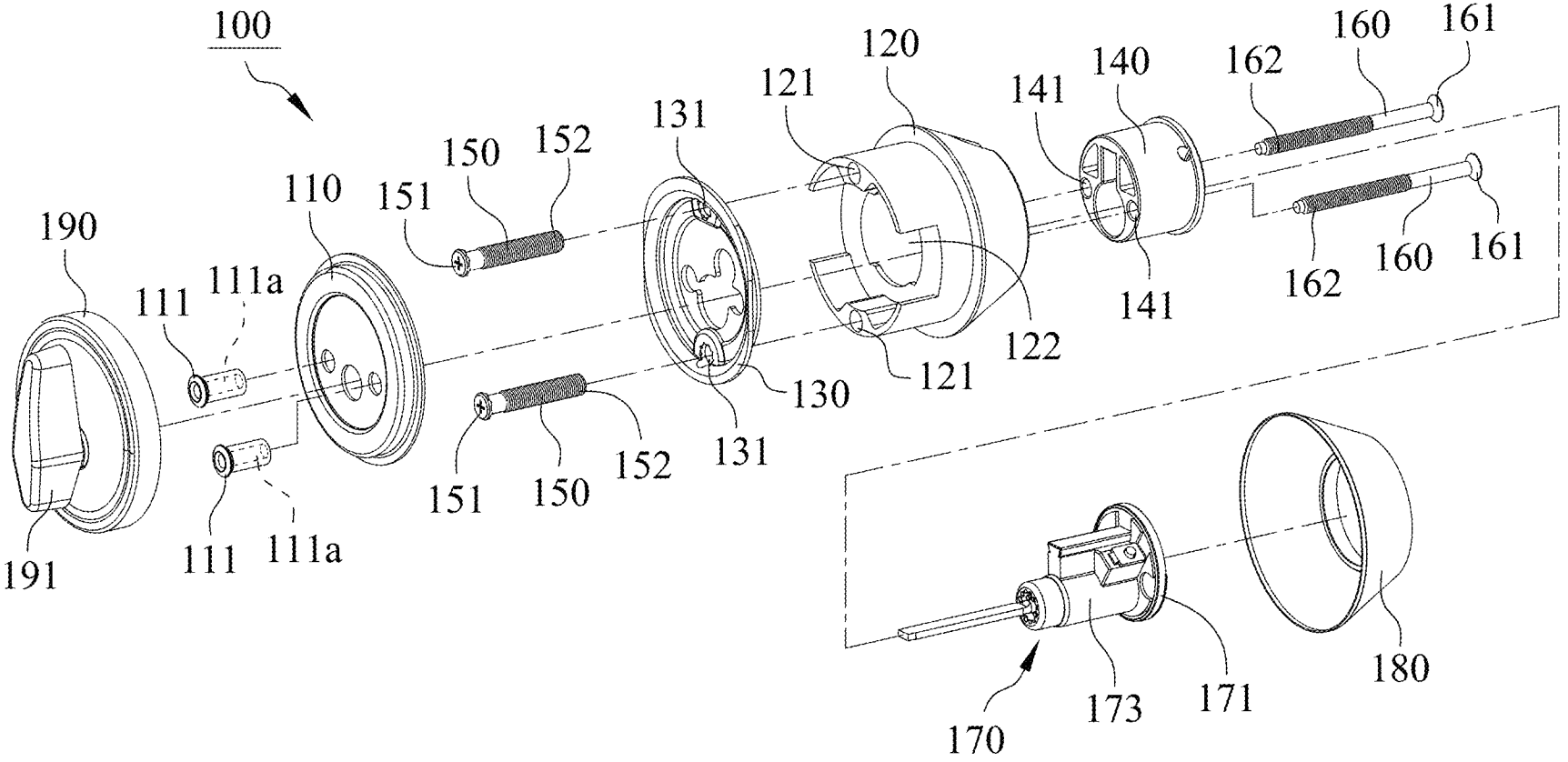
FIG. 4 is a perspective exploded diagram illustrating a lock mechanism in accordance with an embodiment of the present invention.
Figure 5:
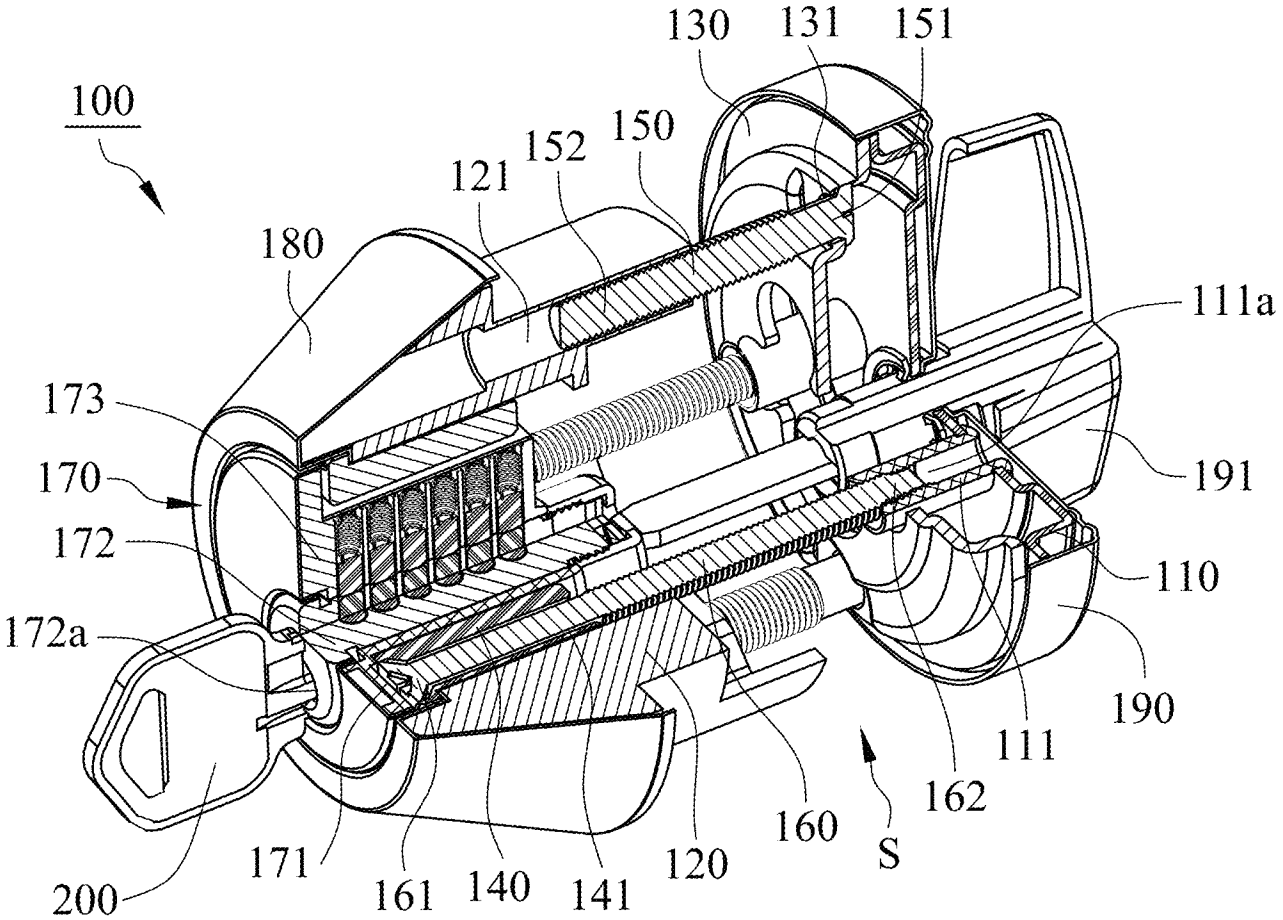
FIG. 5 is a cross-section view diagram illustrating a lock mechanism in accordance with an embodiment of the present invention.

With reference to FIGS. 3 to 5, the restricting plate 130 is coupled to the first mounting plate 110 and located between the first mounting plate 110 and the second mounting plate 120. The first fixing element 150 having a first end 151 and a second end 152 is penetrated through the restricting plate 130 in a direction from the restricting plate 130 toward the second mounting plate 120. In this embodiment, there is at least one first through hole 131 on the restricting plate 130, and the first fixing element 150 is penetrated through the first through hole 131 of the restricting plate 130. Otherwise, the first end 151 is restricted on the restricting plate 130 and the second end 152 is coupled to the second mounting plate 120. The second mounting plate 120 in this embodiment has at least one second coupling hole 121 and the second end 152 of the first fixing element 150 is coupled to the second coupling hole 121 so a clamping space S is formed between the restricting plate 130 and the second mounting plate 120. The first fixing element 150 is, but not limited to, a screw, the first end 151 and the second end 152 are screw head and screw thread respectively. The clamping space S in the lock mechanism 100 is designed to clamp the door and is corresponding to an installation hole (not shown) on the door. A latchbolt assembly (not shown) can be installed in the clamping space S and the installation hole to connect the lock mechanism 100, as a result, the lock mechanism 100 is able to actuate the latchbolt assembly.

With reference to FIGS. 3 to 5, the fixing base 140 is disposed on the second mounting plate 120, and more particularly, the fixing base 140 of this embodiment is disposed in an accommodation space 122 of the second mounting plate 120. In other embodiment, the fixing base 140 may be integrated with the second mounting plate 120.

With reference to FIGS. 3 to 5, the second fixing element 160 has a third end 161 and a fourth end 162 and is penetrated through the fixing base 140 in a direction from the fixing base 140 toward the first mounting plate 110. In this embodiment, the fixing base 140 has at least one second through hole 141, the second fixing element 160 is penetrated through the second through hole 141 of the fixing base 140. The third end 161 is restricted on the fixing base 140 and the fourth end 162 is coupled to the first mounting plate 110. The second fixing element 160 is preferably a screw, and the third end 161 and the fourth end 162 are screw head and screw thread respectively.

With reference to FIGS. 3 to 5, the first mounting plate 110 includes at least one fixing column 111 in this embodiment and the fixing column 111 has a first coupling hole 111*a* provided for coupling with the fourth end 162 of the second fixing element 160. The fixing column 111 may be integrated with the first mounting plate 110 or capable of being separated from the first mounting plate 110 for replacing other fixing column 111 having different hole size.

With reference to FIGS. 3 to 5, the lock mechanism 100 further includes a lock cylinder 170 and an escutcheon 180. The lock cylinder 170 is mounted on the fixing base 140 along a direction from the second mounting plate 120 toward the restricting plate 130 and includes a covering plate 171 provided to cover the third end 161 of the second fixing element 160. The escutcheon 180 is used to cover the second mounting plate 120 and reveal a key hole 172*a* of the lock cylinder 170. In this embodiment, the lock cylinder 170 includes a plug 172 where the key hole 172*a* is located.

Figure 6:
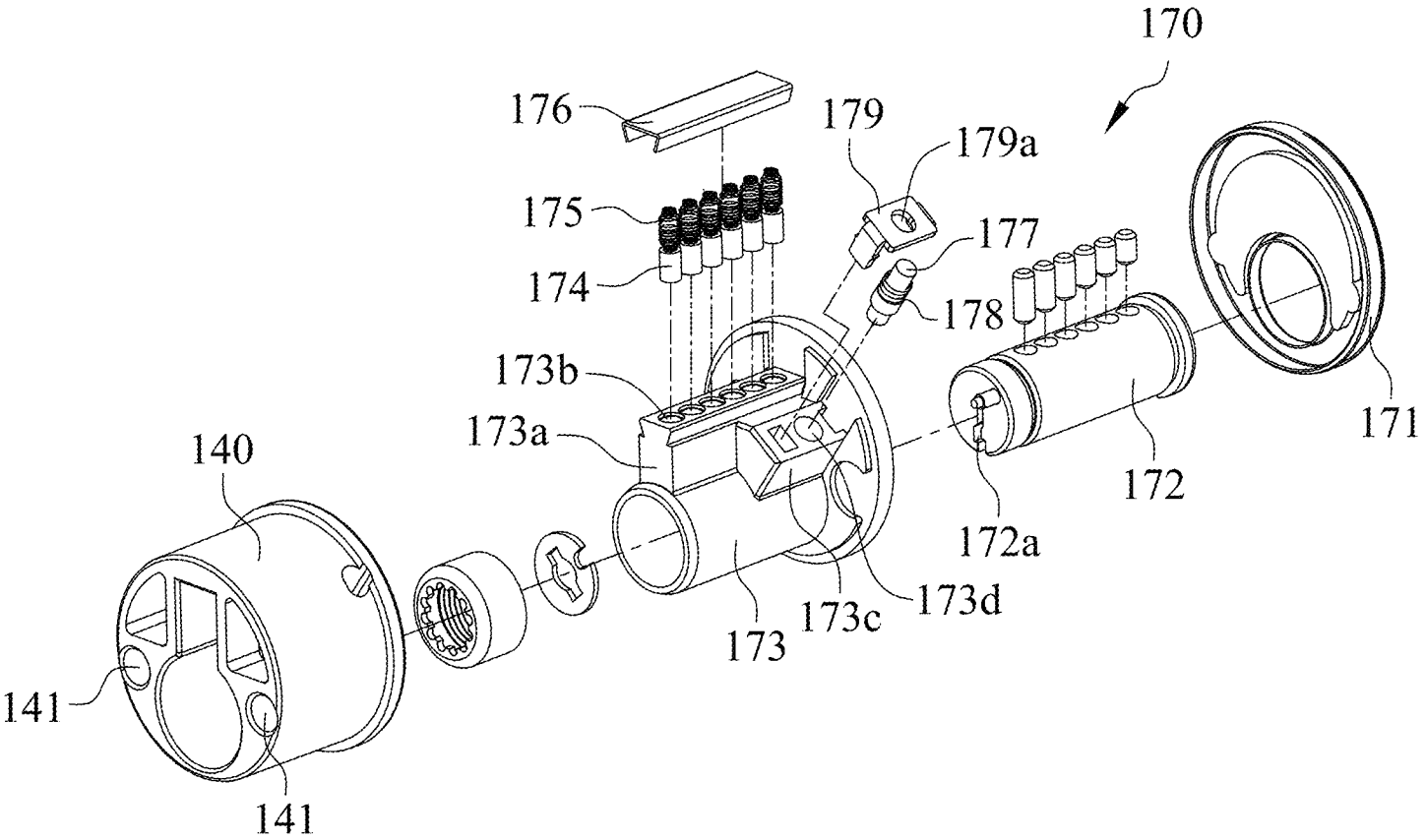
FIG. 6 is a perspective exploded diagram illustrating a lock cylinder in accordance with an embodiment of the present invention.

With reference to FIG. 6, the lock cylinder 170 of this embodiment further includes a housing 173 having a pin chamber 173*a*, a plurality of pin holes 173*b*, a blocking base 173*c* and at least one through hole 173*d*. The plug 172 is movably disposed in the housing 173, the pin holes 173*b* are formed on the pin chamber 173*a*, the through hole 173*d* is located on the blocking base 173*c*, the pin holes 173*b* and the through hole 173*d* are selectively communicated with the key hole 172*a*.

With reference to FIG. 6, the lock cylinder 170 preferably further includes a plurality of pins 174, a plurality of springs 175, a cap 176, at least one blocking pin 177, at least one pushing spring 178 and a blocking plate 179. The pin holes 173*b* are designed to accommodate the pins 174 and the springs 175 and are covered by the cap 176. The through hole 173*d* is provided to accommodate the blocking pin 177 and the pushing spring 178 and is covered by the blocking plate 179. In this embodiment, the pushing spring 178 is located between the blocking plate 179 and the blocking pin 177 and used to push the blocking pin 177 to selectively block the housing 173 and the plug 172. Preferably, the blocking plate 179 has a relief hole 179*a* which provides a relief space for the movement of the blocking pin 177.

With reference to FIGS. 3 to 5, the lock mechanism 100 further includes a knob assembly 190 covering the first mounting plate 110. In this embodiment, the knob assembly 190 includes a knob 191 used to drive the latchbolt assembly in operation with the lock cylinder 170.

With reference to FIGS. 1 to 5, if the lock mechanism 100 mounted on the door has broken component or replacing-required component need to be disassembled, lock installer can disassemble and replace the component from only one side of the door. For example, the installer can replace the lock cylinder 170 from one side of the door by only separating the escutcheon 180 of the lock mechanism 100. Furthermore, if the lock cylinder 170 and the fixing base 140 need to be replaced, the installer can disassemble the fixing base 140 from the lock mechanism 100 after removing the escutcheon 180, the lock cylinder 170 and the second fixing element 160 from one side sequentially. Disassemble of the whole lock mechanism 100 is not required for replacing the fixing base 140 and the lock cylinder 170, hence assembly and disassembly operations of the lock mechanism 100 are simplified.

Figure 8:
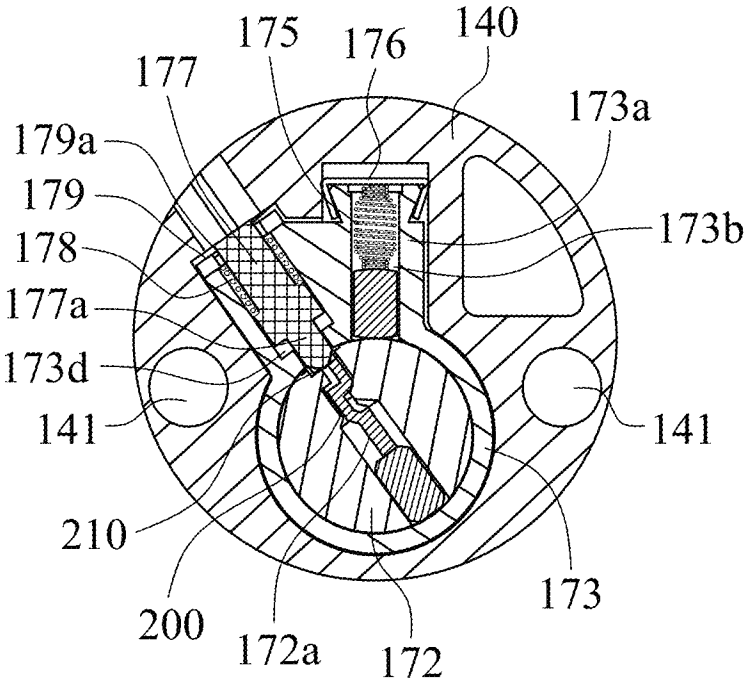
FIG. 8 is a cross-section view diagram illustrating a lock cylinder operated by a key in accordance with an embodiment of the present invention.
Figure 7:
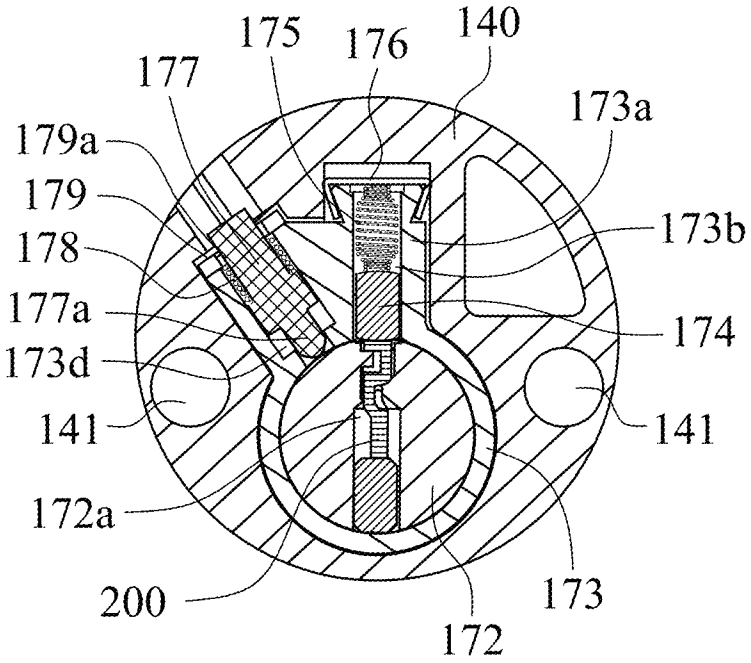
FIG. 7 is a cross-section view diagram illustrating a lock cylinder in accordance with an embodiment of the present invention.
Figure 9:
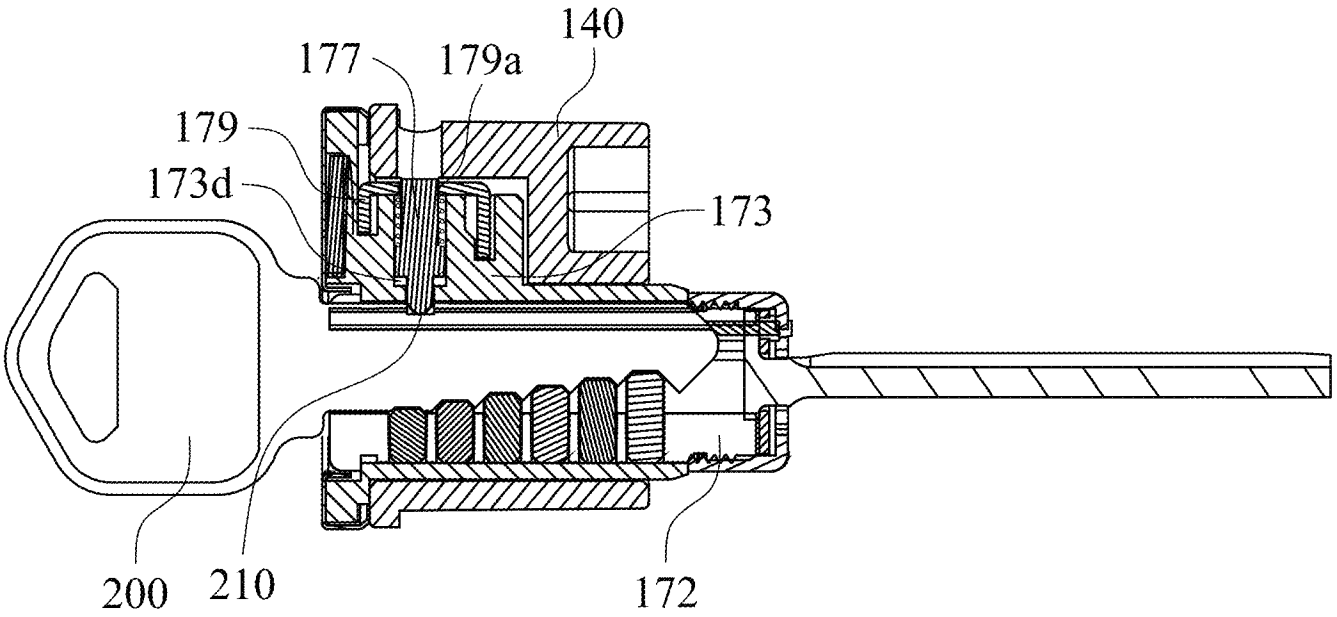
FIG. 9 is a cross-section view diagram illustrating a lock cylinder operated by a key in accordance with an embodiment of the present invention.

With reference to FIGS. 5, 7, 8 and 9, the lock mechanism 100 further includes a control key 200 having a relief groove 210. As shown in FIGS. 7, 8 and 9, while intending to replace the lock cylinder 170, lock installer can insert the control key 200 into the key hole 172*a* to rotate the plug 172 until the through hole 173*d* corresponds to the key hole 172*a*. A blocking end 177*a* of the blocking pin 177 can fall into the relief groove 210 of the control key 200 to block the housing 173 and the plug 172 together when the through hole 173*d* corresponds to the key hole 172*a*, such that the control key 200 cannot rotate the plug 172 anymore and pulling out the control key 200 can separate the lock cylinder 170 from the fixing base 140 due to the control key 200 can pull the housing 173 and the plug 172 out together by the aid of the blocking pin 177.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A lock mechanism, comprising:

a first mounting plate;

a second mounting plate;

a restricting plate coupled to the first mounting plate and located between the first and second mounting plates;

a fixing base disposed on the second mounting plate;

at least one first fixing element having a first end and a second end, the at least one first fixing element is penetrated through the restricting plate in a direction from the restricting plate toward the second mounting plate, wherein the first end is restricted on the restricting plate and the second end is coupled to the second mounting plate such that a clamping space is formed between the restricting plate and the second mounting plate;

at least one second fixing element having a third end and a fourth end, the at least one second fixing element is penetrated through the fixing base in a direction from the fixing base toward the first mounting plate, wherein the third end is restricted on the fixing base and the fourth end is coupled to the first mounting plate; and a lock cylinder disposed on the fixing base, a covering plate of the lock cylinder covers the third end of the at least one second fixing element.

2. The lock mechanism in accordance with claim 1, wherein the first mounting plate includes at least one fixing column having a first coupling hole, and the fourth end of the at least one second fixing element is coupled to the first coupling hole.

3. The lock mechanism in accordance with claim 1, wherein there is at least one second coupling hole on the second mounting plate, and the second end of the at least one first fixing element is coupled to the at least one second coupling hole.

4. The lock mechanism in accordance with claim 1 further comprising an escutcheon, wherein the escutcheon covers the second mounting plate and reveals a key hole of the lock cylinder.

5. The lock mechanism in accordance with claim 1 further comprising a knob assembly covering the first mounting plate.

6. The lock mechanism in accordance with claim 1, wherein the second mounting plate includes an accommodation space and the fixing base is disposed in the accommodation space.

7. The lock mechanism in accordance with claim 6, wherein the fixing base is integrated with the second mounting plate.

8. The lock mechanism in accordance with claim 6, wherein there is at least one second through hole on the fixing base and the at least one second fixing element is penetrated through the at least one second through hole of the fixing base.

9. The lock mechanism in accordance with claim 4, wherein the lock cylinder includes a plug, a housing, at least one blocking pin, at least one pushing spring and a blocking plate, the key hole is formed on the plug, the plug is rotatably disposed in the housing, the housing includes a blocking base and at least one through hole, the at least one through hole is located on the blocking base and is selectively communicated with the key hole, the at least one blocking pin and the at least one pushing spring are disposed in the at least one through hole, the at least one pushing spring is provided to push the at least one blocking pin to selectively block the housing and the plug, the blocking plate covers the at least one through hole.

10. The lock mechanism in accordance with claim 9 further comprising a control key having a relief groove, wherein a blocking end of the at least one blocking pin falls into the relief groove when the at least one through hole corresponds to the key hole.

11. A lock mechanism, comprising:

a first mounting plate;

a second mounting plate including an accommodation space;

a restricting plate coupled to the first mounting plate and located between the first and second mounting plates;

a fixing base disposed in the accommodation space of the second mounting plate;

at least one first fixing element having a first end and a second end, the at least one first fixing element is penetrated through the restricting plate in a direction from the restricting plate toward the second mounting plate, wherein the first end is restricted on the restricting plate and the second end is coupled to the second mounting plate such that a clamping space is formed between the restricting plate and the second mounting plate; and at least one second fixing element having a third end and a fourth end, the at least one second fixing element is penetrated through the fixing base in a direction from the fixing base toward the first mounting plate, wherein the third end is restricted on the fixing base and the fourth end is coupled to the first mounting plate.

12. The lock mechanism in accordance with claim 11, wherein the first mounting plate includes at least one fixing column having a first coupling hole, and the fourth end of the at least one second fixing element is coupled to the first coupling hole.

13. The lock mechanism in accordance with claim 11, wherein there is at least one second coupling hole on the second mounting plate, and the second end of the at least one first fixing element is coupled to the at least one second coupling hole.

14. The lock mechanism in accordance with claim 11 further comprising a lock cylinder and an escutcheon, wherein the lock cylinder is disposed on the fixing base and a covering plate of the lock cylinder covers the third end of the at least one second fixing element, the escutcheon covers the second mounting plate and reveals a key hole of the lock cylinder.

15. The lock mechanism in accordance with claim 11 further comprising a knob assembly covering the first mounting plate.

16. The lock mechanism in accordance with claim 11, wherein the fixing base is integrated with the second mounting plate.

17. The lock mechanism in accordance with claim 11, wherein there is at least one second through hole on the fixing base and the at least one second fixing element is penetrated through the at least one second through hole of the fixing base.

18. The lock mechanism in accordance with claim 14, wherein the lock cylinder includes a plug, a housing, at least one blocking pin, at least one pushing spring and a blocking plate, the key hole is formed on the plug, the plug is rotatably disposed in the housing, the housing includes a blocking base and at least one through hole, the at least one through hole is located on the blocking base and is selectively communicated with the key hole, the at least one blocking pin and the at least one pushing spring are disposed in the at least one through hole, the at least one pushing spring is provided to push the at least one blocking pin to selectively block the housing and the plug, the blocking plate covers the at least one through hole.

19. The lock mechanism in accordance with claim 18 further comprising a control key having a relief groove, wherein a blocking end of the at least one blocking pin falls into the relief groove when the at least one through hole corresponds to the key hole.

* * * * *